United States Patent [19]

Clonces

[11] 4,456,044

[45] Jun. 26, 1984

[54] STARTER WEDGE FOR SPLITTING WOOD

[76] Inventor: Michael E. Clonces, 402 W. 6th, Alexandria, Ind. 46001

[21] Appl. No.: 345,070

[22] Filed: Feb. 2, 1982

[51] Int. Cl.[3] ..... B27L 7/00

[52] U.S. Cl. ..... 144/193 D; 145/2 R; 254/104

[58] Field of Search ..... 144/193 C, 193 D, 193 R; 254/104; 145/1 R, 2 R

[56] References Cited

U.S. PATENT DOCUMENTS

| | | | |
|---|---|---|---|
| 345,153 | 7/1886 | Latchford | 254/104 |
| 1,195,423 | 8/1916 | Waters | 254/104 |
| 1,265,276 | 5/1918 | Stephens | 145/2 R |
| 2,804,109 | 8/1957 | Fatica | 145/2 R |
| 3,191,909 | 6/1965 | Reischl | 254/104 |

FOREIGN PATENT DOCUMENTS

| | | | |
|---|---|---|---|
| 1212471 | 10/1959 | France | 254/104 |

*Primary Examiner*—W. D. Bray

*Attorney, Agent, or Firm*—George A. Gust

[57] ABSTRACT

A starter wedge for splitting wood includes an elongated metallic body having two opposed wedging surfaces which converge from a head end toward a penetrating end. The body is also provided with two spaced longitudinally extending sides between such ends. The penetrating end is in the form of a chisel edge with at least one portion thereof pointed. The chisel edge extends from the pointed portion to the sides and is sharpened to a knife edge which merges with the wedging surfaces.

8 Claims, 13 Drawing Figures

STARTER WEDGE FOR SPLITTING WOOD

BACKGROUND OF THE INVENTION

1. Field of the Invention

The present invention relates to wood-splitting wedges and more particularly to a wedge for starting a crack into which may be inserted a conventional wedge for completing the splitting.

2. Description of the Prior Art

Conventional wedges are elongated and have four sides, two of these converging to a chisel edge. The wedge is used to split wood rounds by impacting the head end with a sledgehammer. Normally, the wedge is hand held prior to the initial impact which constitutes a hazard to the person holding the wedge should the initial blow miss its mark. A further hazard lies in the effect of the wedge bouncing and not penetrating on the initial blow, which has resulted in the wedge flying off in unpredictable directions and causing injury to a person or property. Prior art wedges have taken different designs and configurations, typical of these being disclosed in the following listed U.S. Pat. Nos. 212,230; 1,283,195; 3,982,572; 4,033,390; 4,209,046 and U.S. Pat. No. De. 257,575.

The aforesaid U.S. Pat. No. 4,209,046 discloses in combination with a conventional wedge a pair of orthogonally related quartering blades, it being the intention to quarter a wood round for a single usage of the wedge device. The problems explained hereinabove still remain since the portion of the wedge device which initially penetrates the wood round is the chisel edge of the conventional wedge portion thereof.

SUMMARY OF THE INVENTION

This invention pertains to a starter wedge for splitting wood which includes an elongated metallic body having two opposed wedging surfaces which converge from a head toward a penetrating end. The body is also provided with two spaced longitudinally extending lateral sides between such ends. The penetrating end is in the form of a chisel edge with at least one portion thereof pointed. The chisel edge extends from the pointed portion to the sides and is sharpened to a knife edge which merges with at least one of the wedging surfaces. The chisel edge may take on different configurations, such as transverse straight, arcuate, V or a combination of these.

For enhancing safety, a handle which may be grasped is removably secured at one end to the wedge to extend laterally therefrom. A threaded connection is preferred, since the handle can be easily removed from the wedge after it has once been started.

It is an object of this invention to provide a wedge for starting a crack in a wood round or the like to be split following which a conventional wedge may be inserted into the crack for the purpose of completing the splitting.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
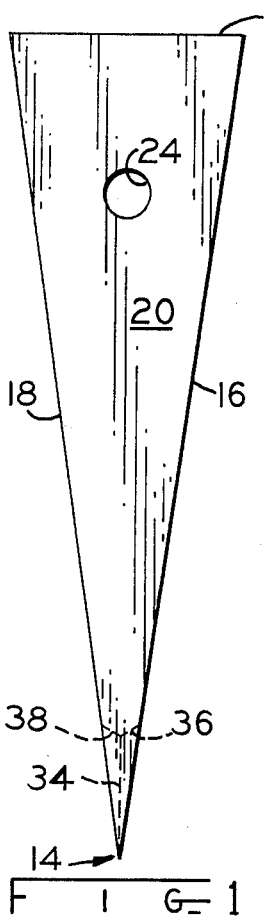
FIG. 1 is a side view of one embodiment of this invention.
Figure 2:
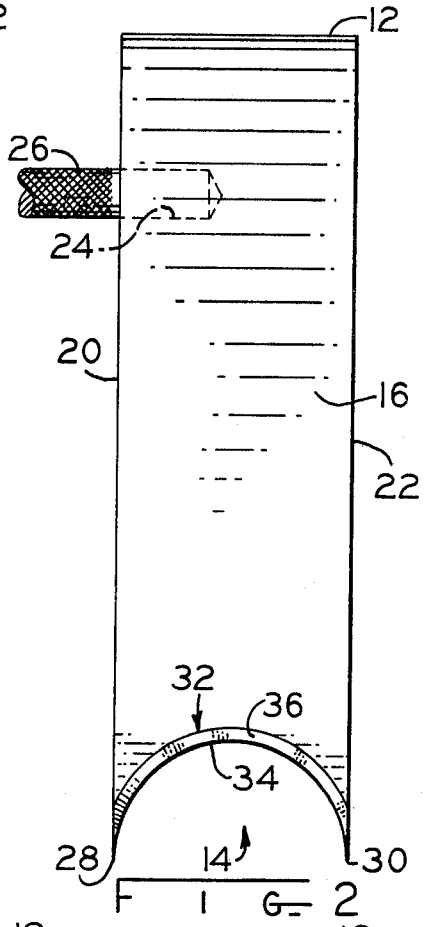
FIG. 2 is a front view thereof.
Figure 3:
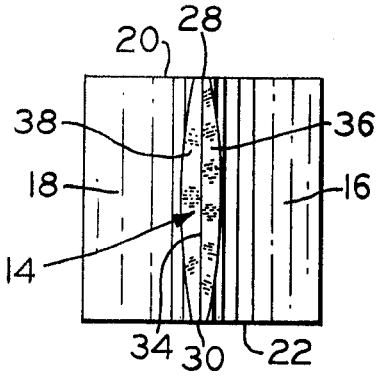
FIG. 3 is an end view thereof.
Figure 4:
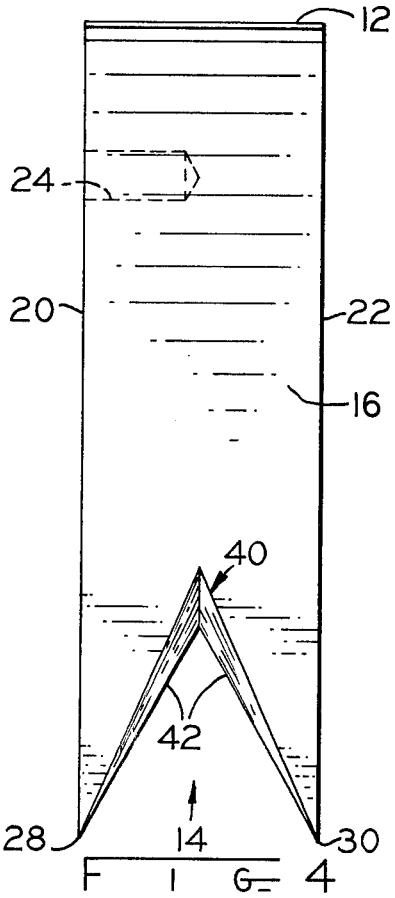
FIG. 4 is a front view of a second embodiment of this invention.
Figure 7:
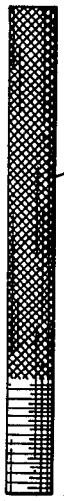
FIG. 7 is a side view of a handle which may be removably secured to the wedge embodiments of this invention.
Figure 13:
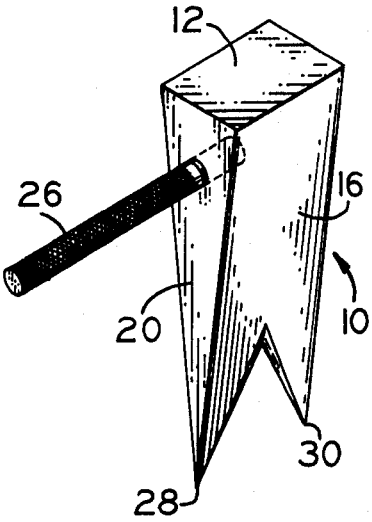
FIG. 13 is a perspective view showing the handle of FIG. 7 affixed to one of the wedges of the preceding figures.

The preferred embodiments of this invention are disclosed in FIGS. 2 and 4. Referring first to FIGS. 1 through 3, the starter wedge there shown includes an enlongated body generally indicated by the numeral 10 having a head or impacting end 12, a penetrating end 14, two flat wedging surfaces 16 and 18 which converge onto the penetrating end 14 and two flat, parallel sides 20 and 22. The body 10 preferably is formed of drop forged steel but may be made of other standard wedge metals. A threaded hole 24 is provided in one of the sides 20 and 22 as shown whereby an elongated handle 26, also threaded, may be removably secured thereto (FIGS. 7 and 13).

Still referring to FIGS. 1 through 3, the penetrating end 14 is formed with two points 28 and 30 transversely aligned and a chisel edge 32 of semi-circular shape which recedes and extends therebetween. The chisel edge portion 32 is sharpened to a knife edge as indicated by the numeral 34 to provide diverging surfaces 36 and 38 which smoothly merge at an obtuse angle with the wedge surfaces 16 and 18, respectively.

Figure 5:
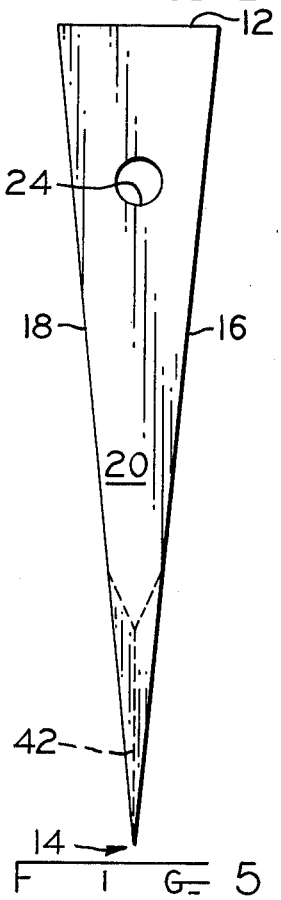
FIG. 5 is a side view of the embodiment of FIG. 4.
Figure 6:
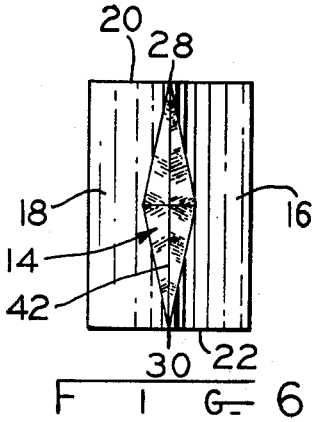
FIG. 6 is an end view of the embodiment of FIG. 4.

Referring next to the embodiment of FIGS. 4 through 6, like numerals indicate like parts. In this embodiment, the chisel edge 40 is formed to a V-shape as shown which is sharpened to a knife edge 42. The angle of the "V" is preferably about 60°.

Figure 8:
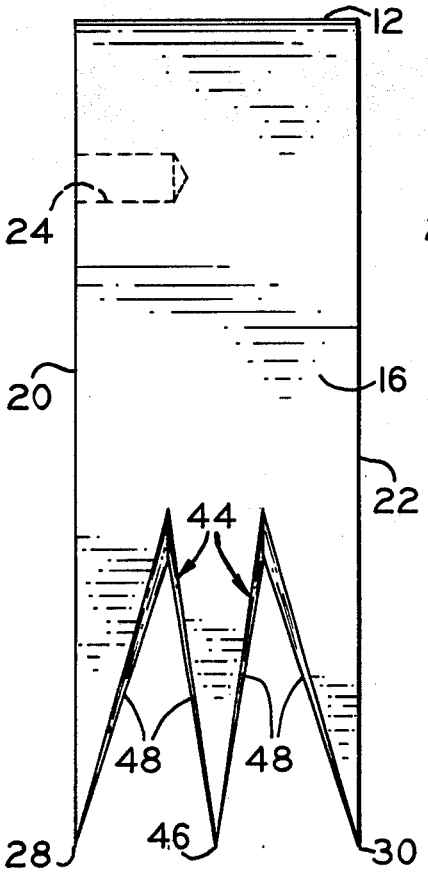
FIG. 8 is a front view of still another embodiment of this invention.
Figure 9:
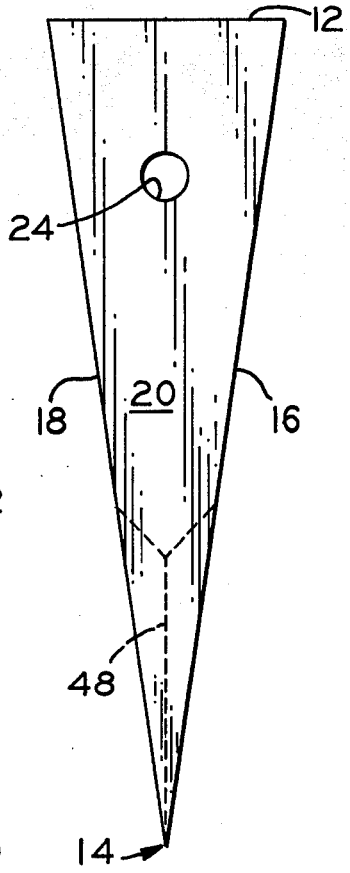
FIG. 9 is a side view thereof.

The embodiment shown in FIGS. 8 and 9 is like that of the preceding figures with the exception that the chisel edge 44 is formed to a double V-shape thereby adding a third point 46 which is midway between and transversely aligned with the two points 28 and 30. These double "V" portions are sharpened to a knife edge 48 extending from the points 28, 30, 46 in the same manner as in the preceding embodiments.

Figure 10:
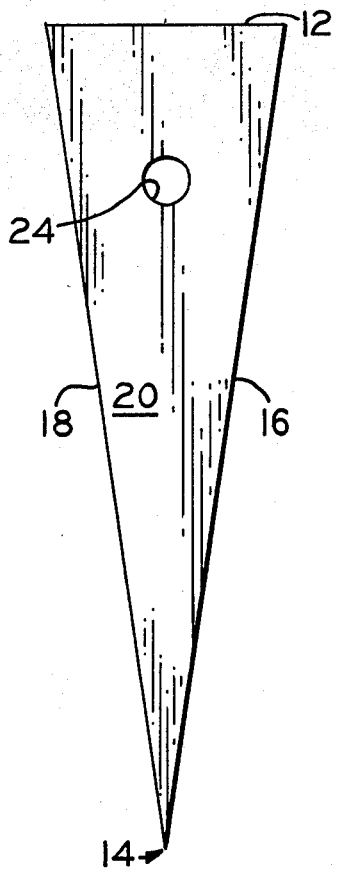
FIG. 10 is a side view of two different embodiments shown in FIGS. 11 and 12.
Figure 11:
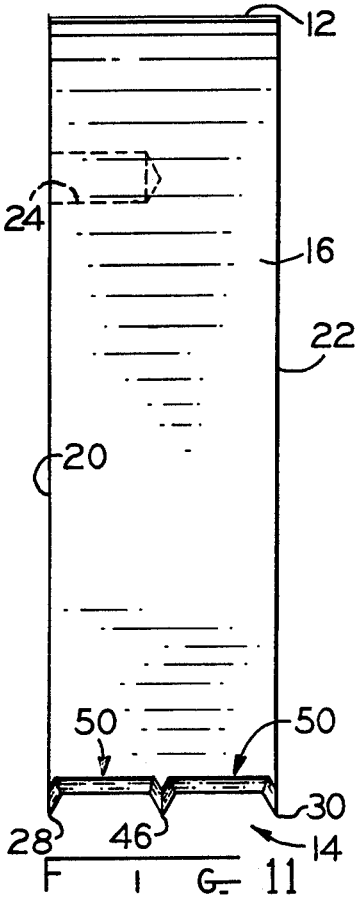
Figure 12:
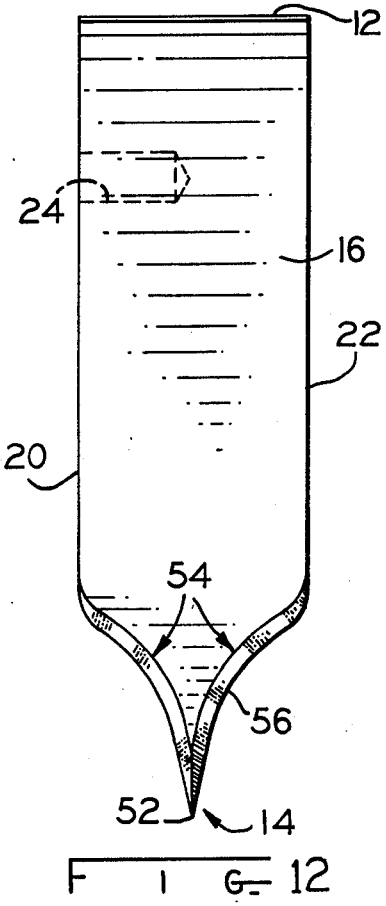

FIGS. 11 and 12 illustrate two further, different embodiments of this invention regarding which FIG. 10 is a side view. The penetrating end 14 in the embodiment of FIG. 11 has three, nail-like points 46 and two straight, transversely extending chisel edge portions 50 connecting the center point 46 with the two outer points 28 and 30. The chisel edges 40 are sharpened to a knife edge as shown which extends to the distal ends of the points 28, 30, 46.

FIG. 12 is a form in which only a single point 52 is provided on the penetrating end 14 midway between the sides 20 and 22, the chisel edge 54 extending curvilinearly and obliquely from the tip of the point 52 to the two sides 20 and 22 as shown. The chisel edge 54 is sharpened to a knife edge as indicated by the numeral 56.

In use, the handle 26 is attached to the starter wedge 10, and the wedges placef in position, pointed down, on a wood round or block to be split. While the wedge is so held, the head 12 is impacted in a conventional manner by means of a sledgehammer. Because of the point on the penetrating end 14, the wedge relatively easily impales into the wood to a depth depending upon the force of the impact as well as the character of the wood itself. Repeated blows easily deepen the penetration, this being facilitated by reason of the knife edge which extends from the point or points into the tapered surfaces on the wedge. When the wedge is driven deeply enough, a crack starts in the wood and further sledging is stopped.

At this point, a conventional wedge is inserted into the formed crack. With the starter wedge either in place or hammered sideways out of the crack, the conventional wedge is conventionally pounded until the wood is split apart. The wedge of this invention is used only for the purpose of starting the crack.

Increased safety results from using the present invention in a number of respects, one being improving the likelihood of successfully setting the wedge upon the first impact. Secondly, since the penetrating edge of the wedge has one or more points, the edge is impaled into the wood with much less risk of the wedge "bouncing out". It is well known that in some instances it is difficult and troublesome to start a conventional wedge, especially in those circumstances in which the wood is frozen, hard or of such irregularity as resists penetration. By use of the handle, the hand is safety positioned away from the sledge blow. As soon as the wedge is impaled, the handle can be unscrewed and pounding continued. Once the wedge is set, the risk of the wedge becoming accidentally dislodged and flying to the side much like a projectile is substantially minimized. Thus, use of the present invention provides a degree of safety in splitting wood not heretofore available. Splitting is, of course, facilitated by reason of the two step process of first starting a crack and then finishing by insertion into the crack of a conventional wedge.

While there have been described above the principles of this invention in connection with specific apparatus, it is to be clearly understood that this description is made only by way of example and not as a limitation to the scope of the invention.

What is claimed is:

1. A starter wedge for splitting wood comprising an elongated metallic body having two opposed wedging surfaces which converge from a head end toward a penetrating end, said body also having two spaced longitudinally extending lateral sides extending between said ends, said penetrating end being in the form of a chisel edge with at least one portion thereof being pointed, said chisel edge extending (from said pointed portion to) between said sides and being sharpened to a knife edge which merges with at least one of said wedging surfaces, said chisel edge receding from the pointed portion of the penetrating end so that initial contact of the chisel edge with a piece of wood being split occurs progressively along the chisel edge as the wedge precedes into the wood.

2. The wedge of claim 1 wherein said chisel edge includes two pointed portions extending longitudinally beyond and in alignment with said two sides, respectively, said knife edge extending transversely of said body between said two pointed portions and further receding from said two pointed portions toward said head.

3. The wedge of claim 1 wherein said pointed portion longitudinally projects beyond the said knife edge substantially midway between said sides, said knife edge extending obliquely from said pointed portion on opposite sides thereof to said sides, respectively.

4. The wedge of claim 2 wherein said knife edge is arcuately shaped.

5. The wedge of claim 2 wherein said knife edge is V-shaped.

6. The wedge of claim 1 wherein said chisel edge includes three pointed portions extending longitudinally beyond said knife edge, two of said pointed portions being aligned with said opposite sides, respectively, and the third pointed edge being disposed substantially midway therebetween.

7. The wedge of claim 6 wherein said knife edge extends transversely between said points.

8. The wedge of claim 6 wherein said knife edge is in the form of two laterally spaced V-sections.

* * * * *